United States Patent [19]

Ohtake et al.

[11] Patent Number: 4,863,887

[45] Date of Patent: Sep. 5, 1989

[54] ADDITIVE FOR THE HYDROCONVERSION OF A HEAVY HYDROCARBON OIL

[75] Inventors: Nobumitsu Ohtake, Tokyo; Tokitaka Kaneshima, Kurashiki, both of Japan

[73] Assignee: Asahi Kasei Kogyo Kabushiki Kaisha, Osaka, Japan

[21] Appl. No.: 131,437

[22] Filed: Dec. 11, 1987

[30] Foreign Application Priority Data

Dec. 12, 1986 [JP] Japan ..... 61-294980

[51] Int. Cl.[4] ..... B01J 31/34; B01J 27/051; B01J 21/18; C10G 47/26

[52] U.S. Cl. ..... 502/150; 208/108; 208/110; 208/112; 208/149; 208/216 R; 208/251 H; 208/254 H; 502/151; 502/182; 502/220

[58] Field of Search ..... 502/150, 180, 182, 183, 502/185, 211, 216, 220, 151

[56] References Cited

U.S. PATENT DOCUMENTS

| | | | |
|---|---|---|---|
| 3,235,508 | 2/1966 | Mills | 252/130 |
| 4,134,825 | 1/1979 | Bearden, Jr. et al. | 208/108 |
| 4,169,038 | 9/1979 | Metrailer et al. | 208/10 |
| 4,214,977 | 7/1980 | Ranganathan et al. | 208/108 |
| 4,285,804 | 8/1981 | Jacquin et al. | 208/48 R |
| 4,299,685 | 11/1981 | Khulbe et al. | 208/48 AA |
| 4,357,229 | 11/1982 | Bearden, Jr. et al. | 208/10 |
| 4,376,037 | 3/1983 | Dahlberg et al. | 208/111 |
| 4,389,301 | 6/1983 | Dahlberg | 208/149 |
| 4,406,772 | 9/1983 | Sasaki et al. | 208/112 |
| 4,431,520 | 2/1984 | Giuliani et al. | 208/112 |
| 4,495,306 | 1/1985 | Budahn et al. | 502/185 |
| 4,548,700 | 10/1985 | Bearden, Jr. et al. | 208/10 |
| 4,557,822 | 12/1985 | Bearden, Jr. et al. | 208/112 |
| 4,606,809 | 8/1986 | Garg | 208/59 |
| 4,637,870 | 1/1987 | Bearden, Jr. et al. | 208/112 |
| 4,637,871 | 1/1987 | Bearden, Jr. et al. | 208/112 |
| 4,740,489 | 4/1988 | Bearden, Jr. et al. | 502/150 |
| 4,770,764 | 9/1988 | Ohtake et al. | 208/112 |

FOREIGN PATENT DOCUMENTS

| | | |
|---|---|---|
| 60-120791 | 6/1985 | Japan . |
| 2142930A | 1/1985 | United Kingdom . |

*Primary Examiner*—Paul E. Konopka

*Attorney, Agent, or Firm*—Birch, Stewart, Kolasch & Birch

[57] ABSTRACT

There is provided an additive for the hydroconversion of a heavy hydrocarbon oil, which is obtained by suspending a fine powder of a carbonaceous substance and a solution of a heteropolymolybdic acid and/or transition metal salts thereof in a hydrocarbon oil. By the use of the additive of the present invention, the hydroconversion of a heavy hydrocarbon oil can be effectively performed at high conversion without occurrence of coking.

19 Claims, 1 Drawing Sheet

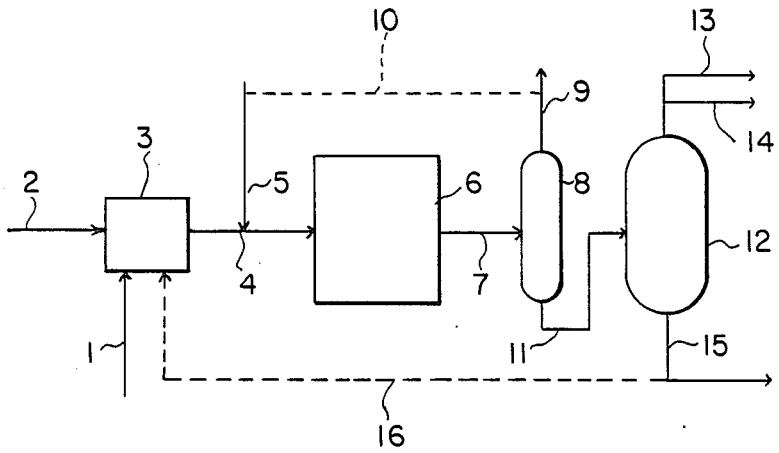
10
13
9
14
3
2
5
6
8
12
4
7
1
11
15
16

ADDITIVE FOR THE HYDROCONVERSION OF A HEAVY HYDROCARBON OIL

BACKGROUND OF THE INVENTION

1. Field of the Invention

The invention relates to an additive for the hydroconversion of heavy hydrocarbon oils. More particularly, the present invention is concerned with an additive which is useful for efficiently hydrocracking heavy hydrocarbon oils into lighter and more valuable oil products while suppressing the production of undesirable by-products. The present invention also relates to a method for the hydroconversion of heavy hydrocarbon oils by the use of the above-mentioned additive.

In the present specification, the terminology "additive" defines a hydrocarbon oil slurry containing a catalyst for the hydroconversion of heavy hydrocarbon oils, or precursors thereof.

2. Discussion of the Prior Art

The hydroconversion of heavy hydrocarbon oils defines a conversion of heavy oils having high boiling points, such as atmospheric or vacuum residual oils, into lighter hydrocarbon oils having lower boiling points, such as naphtha, kerosene, gas oil and vacuum gas oil. The hydroconversion is accomplished by heating the heavy hydrocarbon oils at a high temperature under a high hydrogen pressure. The hydroconversion also includes removal of so-called heteroatoms present in the feedstock heavy oil, such as sulfur, nitrogen, vanadium and nickel, which results in an upgrade of the properties of the produced lighter hydrocarbon oils by the hydrogenation thereof.

In methods for the hydroconversion, there is known a method in which a catalyst is suspended in feedstock heavy oils(hereinafter referred to as "catalytic slurry method"). It is generally acknowledged that this method is effective and useful because, according to this method, the hydroconversion can be effectively carried out even under severe conditions using as the feedstock, a heavy oil containing high concentrations of asphaltene, carbon residue, metallic constituents and ash, for example, vacuum residual oils, while preventing precipitation and deposition of carbonaceous solid substances formed by side reactions such as polymerization and condensation. The catalytic slurry method is advantageous in that the catalyst used is not deteriorated and the reactor is not plugged as opposed to the hydroconversion method using a catalyst in a fixed bed or fluidized bed.

Heretofore, various catalytic slurry methods have been proposed as follows.

U.S. Pat. Nos. 4,134,825, 4,285,804 and 4,548,700 disclose a hydroconversion method in which the hydroconversion of heavy hydrocarbon oils are effected in a system in which a transition metal compound (a catalyst precursor) or a catalyst obtained by decomposing the transition metal compound, is suspended in the heavy hydrocarbon oils so that hydrogenating ability of the transition metal compound may be exerted.

U.S. Pat. Nos. 4,299,685, 4,169,038, 4,406,772 disclose a method in which a solid substance, such as coal ash powder and by-product coke, is suspended in a heavy hydrocarbon oil and the hydroconversion of the oil is carried out mainly by utilizing hydrogen pressure.

Further, there are known hydroconversion methods in which, a solid substance having, supported thereon or impregnated therein, a metal compound which is similar to the state of the catalyst used in a fixed-bed method or a fluidized method, is suspended in a heavy hydrocarbon oil. For example, U.S. Pat. Nos. 4,214,977, 4,495,306 and 4,557,822 disclose a method in which, a metal salt-impregnated coal powder, is suspended in a heavy hydrocarbon oil, and U.S. Pat. No. 4,357,229 discloses a method in which a metal powder having a decomposition product of an oil-soluble metal compound supported thereon Moreover, there are known hydroconversion methods in which a customarily employed metal compound having hydrogenating activity and a powder or granule of a solid substance are separately suspended in a heavy hydrocarbon oil. For example, U.S. Pat. No. 4,376,037 discloses a method in which a granular porous refractory inorganic substance is suspended in a heavy oil together with a metal compound; U.S. Pat. No. 4,431,520 discloses a method in which by-product metal-containing soot particles (cenospheres) are suspended in a heavy oil together with a metal compound; and Japanese Patent Application Laid-Open Specification No. 60-120791 discloses a method in which an ultra fine particulate substance is suspended in a heavy oil together with a metal compound In recent years, with respect to petroleum resources, the supply of heavy oils has been increasing However, with respect to the petroleum products, the demand for lighter oils has also been increasing. Therefore, the uneven balance between the supply of heavy oils and the demand for lighter oils has become a social problem. In order to solve the problem, it is earnestly desired in the art to develop a technically and practically advantageous method for effectively converting heavy crude oils into the more valuable lighter oils. For example, a method for continuously converting vacuum residual oils having boiling points of 538° C. or more into lighter oils having boiling points lower than 538° C. at a conversion level as high as at least 80% by weight, preferably at least 85% by weight, and yet more preferably at least 90% by weight.

To obtain such highly efficient hydroconversion, it has been necessary to suppress the formation of coke- or asphaltene-like polycondensation by-products having been formed by side reactions which inevitably occur in the reaction apparatus, particularly in the reaction zone of the reaction apparatus and to prevent precipitation and deposition of such polycondensation by-product (i.e., scaling or coking) in the reaction apparatus. Further, it has been required that the yield of lighter oils be increased while suppressing excessive gas generation. Moreover, it has been required that the hydrogenation of the hydroconversion products (lighter oils) be effectively performed in order to remove heteroatoms such as sulfur atoms, nitrogen atoms, etc. Further, in the catalytic slurry method in which hydroconversion is conducted in a continuous manner, in order for the method to be rendered simple and easy, at least part of the catalyst is discarded after use. Therefore, it is desirable that the catalyst to be used be effective, even when it is used in a small amount. Accordingly, a catalyst which is expensive or troublesome to produce should not be used.

In addition, there is the problem of handling the residue after recovering low boiling point distillates from the hydroconversion products. In general, hydroconversion is conducted in a continuous manner. In this case, it is desirable that the residue is capable of being used as fuel oils without the necessities of removing or recovering the catalyst therefrom. Thus the hydroconversion process becomes simpler and the operation cost is lowered. However, when the hydroconversion of a raw material heavy oil is conducted at high conversion such that 80% by weight or more of the feedstock heavy oil is converted into lighter oils, residue is formed which has a boiling point higher than 538° C. and which contain the catalyst as well as the polycondensation by-products formed in the reaction zone of the reaction apparatus at concentrations which are at least 5 times, sometimes at least 10 times greater than the concentrations before the hydroconversion reaction. In order for the residual oils formed in the hydroconversion of heavy oils to be fluid and combustible, it is requisite that the catalyst and polycondensation by-products be sufficiently minute and the total content thereof in the residual oils be as low as 40% by weight or less. Further, in order to decrease the amount of ash which is formed when the residual oils are burned, refractory inorganic substances which are conventionally used as support for a catalyst should not be used, or even if used, the amount thereof should be decreased as much as possible.

However, up to the present time the above-mentioned conventional catalytic slurry methods have not been found to be satisfactory.

SUMMARY OF THE INVENTION

The present inventors have made extensive and intensive studies with a view toward developing a catalyst or catalyst or precursor which is suitable for use in conducting hydroconversion of various heavy hydrocarbon oils, particularly the hydroconversion of vacuum residual oils by vacuum distillation of heavy hydrocarbon oils by a catalytic slurry method. As a result, it has unexpectedly been found that when a specific powder of a carbonaceous substance and a solution of a specific molybdenum compound, namely a heteropolyacid which contains molybdenum atoms as polyatoms, or a transition metal salt thereof are suspended in a hydrocarbon oil, the powder and molybdenum compound are uniformly dispersed in the hydrocarbon oil without forming an aggregate of the powder and molybdenum compound also it has unexpectedly been found that when the thus obtained slurry is used as an additive for the hydroconversion of a heavy oil, the molybdenum compound in the slurry is converted to an amorphous molybdenum sulfide, which is excellent in catalytic activity as compared with a crystalline molybdenum sulfide. Accordingly, the hydroconversion of the heavy oil can be efficiently performed. The present invention has been made based on such novel findings Accordingly, an object of the present invention is to provide a novel additive for the hydroconversion of heavy hydrocarbon oils by a catalytic slurry method, the use of which hydroconverts heavy oils into more valuable lighter oils easily, efficiently and at a low cost.

Another object of the present invention is to provide a method for the hydroconversion of heavy hydrocarbon oils using an additive of the type mentioned above.

BRIEF DESCRIPTION OF THE DRAWING

The foregoing and other objects, features and advantages of the present invention will become more fully understood from the following detailed description given hereinbelow and the accompanying drawing, which are given by way of illustration only, and thus are not limitative of the present invention and wherein:

Figure shows a flow chart for practicing the hydroconversion of a heavy hydrocarbon oil according to the method of the present invention.

DETAILED DESCRIPTION OF THE INVENTION

According to the present invention, there is provided an additive for the hydroconversion of a heavy hydrocarbon oil, which is obtained by a process comprising suspending in the hydrocarbon oil:

(i) a powder of a carbonaceous substance having an average primary particle size of from about 1 to about 200 nm, and (ii) a solution comprising at least one molybdenum compound selected from the group consisting of a heteropoly-acid containing a molybdenum atom as the polyatom and transition metal salts thereof, dissolved in an oxygen-containing polar solvent, thereby obtaining a suspension.

Further, according to the present invention, there is also provided a method for the hydroconversion of a heavy hydrocarbon oil which comprises:

(1) adding to a feedstock heavy hydrocarbon oil an additive of the type mentioned above;

(2) heating the resulting mixture in the presence of a hydrogen gas or a hydrogen gas-containing gas to obtain a reaction mixture including hydroconverted oils and an unconverted residue; and (3) recovering the hydroconverted oils.

The powder of a carbonaceous substance to be used in the present invention may be in the form of either primary particles (defined as particles which can be visually recognized as unit particles by means of an electron microscope) or secondary particles (granules of primary particles) and have an average primary particle size of from about 1 to 200 nm. As the powder of a carbonaceous substance to be used in the present invention, it is desirable to use a powder of a carbonaceous substance which is substantially not reactive under the hydroconversion conditions, and which is more lipophilic and wettable with a hydrocarbon oil than the conventionally employed refractory inorganic substance. Therefore, it is preferred to use a powder of a carbonaceous substance consisting substantially of carbon and having an ash content as low as about 1% by weight or less. Such carbonaceous substance may be obtained by the carbonization of hydrocarbons. For example, a carbonaceous substance suitable for use in the present invention may be obtained by the so-called build-up process in which particles of a carbonaceous substance are produced through the formation of nuclei from molecules, ions and atoms and the subsequent growth of the nuclei, that is, by the carbonization of a hydrocarbon material in which the formation of carbonaceous substance is performed through gaseous phase. Examples of powders of carbonaceous substances obtained by the above-mentioned method include pyrolytic carbon and carbon black. Further, powders of carbonaceous substance obtained as by-products in the water gas reaction or in the boiler combustion of hydrocarbons such as heavy oils and ethylene bottom oils, may also be used in the present invention as long as the average primary particle sizes thereof are within the range as mentioned above. Moreover, there may be employed coke and charcoal obtained by the carbonization of heavy oils in the liquid phase or solid phase as long as the ash contents thereof are as low as about 1% by weight or less and they can be pulverized to form particles having an average primary particle size in the range as mentioned above.

Of the powders of carbonaceous substances as mentioned above, the most preferred are carbon blacks. Various carbon blacks are known and commercially produced on a large scale, and they are classified as an oil furnace black, gas furnace black, channel black, thermal black and the like, according to the production method. Most of the carbon blacks have a structure in which the powder particles are chain-like linked by fusion, physical binding or agglomeration, and have an average primary particle size of from about 10 to 150 nm as measured by an electron microscope. Therefore, most of commercially available carbon blacks can be advantageously used in the present invention.

It is preferred that the average primary particle size of the powder of a carbonaceous substance be as small as possible so that the particle surface area per unit weight of the powder would be as large as possible. This would make it easy to support a metal or metal compound having a hydrogenating activity on the well dispersed particles of the powder or to disperse a metal or metal compound around the particles of the powder in a well dispersed state. Further, because of the high dispersion and large free movement of the particles of the powder attained in the reaction zone a non-localized uniform reaction field can be provided for the reaction system. Moreover, the fineness of the powder particles has an advantage in that the powder of a carbonaceous substance is hardly retained in the reaction zone and in the distillation zone. Thus, the polycondensation by-products adsorbed on the powder particles, such as coke precursors and cokes can easily be discharged from the reaction apparatus of a continuous flow system, so that plugging of the reaction apparatus can be prevented.

As mentioned above, the average primary particle size of the powder of a carbonaceous substance is generally within the range of from about 1 to about 200 nm. The average primary particle size may preferably be about 1 to 50 nm, more preferably about 1 to 30 nm. Of course, particles of a carbonaceous substance having an average primary particle size of less than 1 nm may also be used as long as they are in the region of the so-called powder. The average primary particle size can be obtained based on the sizes of the primary particles, which are measured by an electron microscope. For obtaining an average primary particle size, 200 to 500 particles are usually measured in accordance with the ordinarily employed method for measuring particle sizes[reference may be made to, for example, "Funtai Kogaku Binran" (Powder Engineering Handbook) edited by the Funtai Kogakkai (Japanese Society of Powder Engineering) and published by Nikkan Kogyo Sinbun Sha, Japan, pages 1 to 50, 1986].

A furnace black, which is most commonly used as carbon black, is classified as a non-porous substance, although it has a complicated microstructure comprised of an amorphous portion and a microcrystalline portion. Therefore, the surface area of a furnace black substantially depends on its primary particle size. Generally, the surface area of a a furnace black may be about 50 to about 250 $m^2/g$ in terms of a value as measured by a BET method.

A powder of a carbonaceous substance as such may be used in the present invention. Alternatively, a powder obtained by subjecting the powder of carbonaceous substance to a treatment such as oxidation, so that the surface area of the powder is increased, may also be employed in the present invention as long as the average primary particle size of the resulting powder is within the range mentioned before, namely about 1 to about 200 nm, preferably about 1 to about 50 nm, more preferably about 1 to about 30 nm. By the treatment such as oxidation, the amorphous components and microcrystalline components of the primary particles of the powder are oxidized so that various micro pores and macro pores are formed and consequently, the surface area of the powder particle is increased. The resultant surface area of the powder after the treatment is varied according to the method and conditions of the treatment Generally, the thus treated powder has a surface area of about 200 to about 1500 $m^2/g$ in terms of a value as measured by a BET method. For increasing the surface area of a powder, various known oxidation methods may be employed. Examples of oxidation methods include a gaseous phase oxidation method, a liquid phase opdation method, an electrolytic method and the like. In the gaseous phase oxidation method, a gaseous oxidizing agent such as steam, carbon dioxide gas and oxygen gas is uniformly contacted with a powder of a carbonaceous substance while heating. In the liquid phase oxidation method, a liquid oxidizing agent such as nitric acid, chloric acid or sodium hypochlorite is used. In an electrolytic method in which an acid, alkali or salt is used as an electrolyte. By the oxidation treatment, in addition to an increase in the surface area, functional groups such as a carboxyl group, phenolic hydroxyl group and ether group may be introduced on the surface of the powder, so that the acidity of the powder is increased. In such a case, if desired, the powder may be heated in an inert atmosphere to remove such functional groups or, alternatively, such functional groups may be neutralized by a customary method. The above-mentioned treatment may be carried out under suitable conditions, which are chosen taking into consideration the balance between the decreases in weight and average primary particle size, as well as the balance between the increase in surface area and the effect thereof.

In the commercially available carbonaceous substance, there are porous powders which originally had a surface area as high as about 500 to about 1300 $m^2/g$ in terms of a value as measured by a BET method even if the powders are not subjected to oxidation treatment as mentioned above. Such porous powders may be advantageously employed as long as they have an average primary particle size within the range mentioned before.

As mentioned before, it is preferred that the average primary particle size of a powder of a carbonaceous substance be as small as possible so that the surface area of the powder is large. In addition, it is more preferable that the primary particle of the powder of a carbonaceous substance be porous and have a relatively large surface area.

A molybdenum compound used in the present invention is selected from the group consisting of a heteropoly-acid containing a molybdenum atom as the polyatom (hereinafter simply referred to as "heteropolymolybdic acid"), and transition metal salts thereof. A heteropoly-acid is a metal oxide complex which is formed by the condensation of at least 2 kinds of inorganic acids, and has a distinctly unique anion structure and a crystalline configuration. A heteropolymolybdic acid used in the present invention is an acid type of a heteropolymolybdic anion. A heteropolymolybdic anion is formed by the condensation of an oxygen acid of molybdenum (polyatom) with an element of Groups I to VIII of the periodic table as a central atom (hetero atom). There are various heteropolymolybdic anion having different condensation ratios (atomic ratio of heteroatom to polyatom). Examples of the heteropolymolybdic anions include $[X^{+n}Mo_{12}O_{40}]^{-(8-n)}$, $[X^{+n}Mo_{12}O_{42}]^{-(12-n)}$, $[X^{+5}{}_2Mo_{18}O_{62}]^{-6}$, $[X^{+4}Mo_9O_{32}]^{-6}$, $[X^{+n}Mo_6O_{24}]^{-(12-n)}$, $[X^{+n}Mo_6O_{24}H_6]^{-(6-n)}$ and anions which are formed by the partial degradation and those which are present in a solution, such as $[X^{+n}Mo_{11}O_{39}]^{-(12-n)}$ and $[X^{+5}2Mo_{17}O_{61}]^{-10}$ (wherein X represents a heteroatom and n is a valence of X). The acid types of the heteropolymolybdic anions as mentioned above may be used in the present invention. Alternatively, the so-called mixed heteropoly-acid may also be used in the present invention The structures of the so-called mixed heteropoly-acids are characterized in that in the case of the above-mentioned anions, part of molybdenum atoms (polyatoms) has been replaced by a different transition metal such as tungsten and vanadium. Examples of such mixed heteropoly-acids include acid types of anions $[X^{+n}Mo_{12-m}W_mO_{40}]^{-(8-n)}$, $X^{+n}Mo_{12-m}V_mO_{40}]^{-(8-n+m)}$ (wherein X and n are as defined above and m is an integer of 1 to 3) and the like. When m is an integer larger than 3 in the above-mentioned formulae of the anions of the so called mixed heteropoly-acids, the catalytic activity unfavorably decreases according to the increase of m. Representative examples of the anions include $[PMo_{12}O_{40}]^{-13}$, $[SiMo_{12}O_{40}]^{-4}$, $[GeMo_{12}O_{40}]^{-4}$, $P_2MO_{18}O_{62}]^{-6}$, $[CeMo_{12}O_{42}]^{-8}$, $[PMo_{11}VO_{40}]^{-4}$, $SiMo_{11}VO_{40}]^{-5}$, $[GeMo_{11}VO_{40}]^{-5}$, $[PMo_{11}WO_{40}]^{-3}$, $SiMo_{11}WO_{40}]^{-4}$, $[CoMo_6O_{24}H_6]^{-3}$, and reduced forms thereof. Further, although there are various heteropoly-acids containing tungsten atoms only as polyatoms known, such heteropoly-acids cannot be used in the present invention because of the poor catalytic activity associated therewith. The heteropolymolybdic acids and mixed heteropoly-acids may be employed alone or in mixture. In the present invention, the ratio of the number of molybdenum atoms to the total number of polyatoms is preferably at least 0.7.

Most of the above-mentioned heteropolymolybdic acids which may be used in the present application have an excellent oxidizing activity and are likely to be reduced to forms 2-, 4- or 6-electron reduced species (so-called heteropoly blue). For example, a heteropolymolybdic acid represented by the formula $H_3{}^{+3}[PMo_{12}O_{40}]^{-3}$ is reduced to form $H_5{}^{+5}[PMo_{12}O_{40}]^{-5}$ 2-electron reduced species), $H_7{}^{+7}[PMo_{12}O_{40}]^{-7}$ (4-electron reduced species) or $H_9{}^{+9}[PMo_{12}O_{40}]^{-9}$ (6-electron electron reduced species). Such 2-, 4- or 6-electron reduced species may also be used in the present invention. The above-mentioned reduced species of the heteropolymolybdic acid may be obtained by a customary electolytic reduction method or a customary chemical reduction method in which various reducing agents are used.

In the present invention, transition metal salts of the above-mentioned heteropolymolybdic acid may also be employed. The transition metal salts of a heteropolymolybdic acid have a structure in which part or a whole of protons of a heteropolymolybdic acid are replaced by transition metal cations. Examples of the transition metal cations include $Cu^{2+}$, $Mn^{2+}$, $Ni^{2+}$, $Co^{2+}$, $Fe^{3+}$, $Cr^{3+}$, $Zn^{2+}$, and the like. The transition metal salts of a heteropolyacid may be produced by reacting a heteropolymolybdic acid with a transition metal carbonate or a transition metal nitrate in water. In the present invention, due to having poor catalytic activity it is preferred not to use alkali metal salts containing $Na^+$, $K^+$, etc., and alkali earth metal salts containing $Mg^{2+}$, $Ca^{2+}$, etc., as the cations. Further, it is preferred not to use ammonium salts and alkyl ammonium salts of a heteropolymolybdic acid because such salts are also poor in catalytic activity.

According to the present invention, the above-mentioned powder of a carbonaceous substance and the above-mentioned molybdenum compound are suspended in a hydrocarbon oil. In the present invention, it is necessary that the molybdenum compound and powder of a carbonaceous substance are uniformly suspended and well contacted with each other. In order to disperse the molybdenum compound in a hydrocarbon oil uniformly in the colloidal form but not in the aggregate form and to sufficiently contact the molybdenum compound with the powder of a carbonaceous substance, it is necessary that the molybdenum compound be dissolved in a solvent before it is suspended in a hydrocarbon oil together with the powder of a carbonaceous substance. In dissolving the molybdenum compound in a solvent, it is requisite to use a solvent which is capable of dissolving the molybdenum compound in a high concentration and which can be emulsified in a hydrocarbon oil after dissolving a molybdenum compound therein. Examples of such solvents include oxygen-containing polar solvents such as water and an alcohol, ether and ketone of a lower alkyl. From the standpoint of economy, it is most preferred to use water as a solvent. Another reason why the use of water is most preferable resides in the fact that heteropolymolybdic acids are generally synthesized in water and therefore, the aqueous reaction mixture containing a synthesized heteropolymolybdic acid may advantageously be used as such without having to isolate the heteropolymolybdic acid from the reaction mixture.

It is preferred that the molybdenum compound be dissolved in an oxygen-containing polar solvent at a concentration as high as possible, because the higher the molybdenum compound concentration in the solvent, the smaller the amount of a solvent to be used which does not participate in the hydroconversion catalysis. The concentration of the molybdenum compound in the solvent varies according to the types of molybdenum compound and solvent used. Generally, the molybdenum compound may be dissolved in a solvent at a concentration of from about 10% by weight or more as molybdenum. However, the molybdenum compound concentration must not be high to the extent that the molybdenum compound concentration is larger than the solubility of the compound which would result in the compound precipitating in the solvent. In view of the above, the upper limit of the molybdenum compound concentration is generally about 40% by weight as molybdenum although the upper limit is varied according to the types of the molybdenum compound and solvent used. In the case where a molybdenum compound in the solution is relatively unstable and is likely to decompose therein, the molybdenum compound must be promptly suspended in a hydrocarbon oil before the complete decomposition of the molybdenum compound occurs. Alternatively, such a molybdenum compound may be stabilized by a customary method.

For example, in the case of an aqueous solution of a heteropolymolybdic acid of the formula $H_3[PMo_{12}O_{40}]$, a phosphate ion may be added to the solution as a stabilizing agent.

In preparing an additive of the present invention, the order of addition of the powder of a carbonaceous substances and the solution of a molybdenum compound to a hydrocarbon oil is not critical. They may also be simultaneously added to a hydrocarbon oil.

The hydrocarbon oil to be used in the present invention may be oils derived from a petroleum which contain a sulfur compound and a nitrogen compound. Preferred examples of hydrocarbon oils include fuel oils as defined in JIS K 2205. The hydrocarbon oil may also be the same as the one which is to be used as a feedstock heavy hydrocarbon oil for the hydroconversion.

By suspending the powder of a carbonaceous substance and the solution of a molybdenum compound in a hydrocarbon oil to thereby contact the powder with the solution, a colloidal compound having as a skeletal structure an anion of the heteropolymolybdic acid is formed and combined with the powder of a carbonaceous substance to form a peculiar slurry. The structure of the formed colloidal molybdenum compound which is no longer in the dissolved state in a hydrocarbon oil has not yet been elucidated. However, it is possible that the colloidal molybdenum compound is interacted with the powder of a carbonaceous substance and, in addition, with a nitrogen compound contained in the hydrocarbon oil.

In preparing an additive of the present invention, it is important and necessary to sufficiently conduct an operation for suspending the powder of a carbonaceous substance and the solution of a molybdenum compound in a hydrocarbon oil so that the powder, molybdenum compound and oil can be well contacted with one another and a uniform slurry can be obtained. The suspending operation may advantageously be carried out by a customary technique, for example by using a disperser or a mill which is capable of generating a high shearing force, and, if desired, by using an emulsifier, or a surfactant such as a petroleum sulfonate, fatty acid amide, naphthenate, alkyl sulfosuccinate, alkyl phosphate, ester of a fatty acid with polyoxyethylene, polyoxyethylene sorbitan fatty acid ester, ester of a fatty acid with glycerol, a sorbitan fatty acid ester and a polycarbonic acid-amine salt type high molecular weight surfactant.

As mentioned before, the powder of a carbonaceous substance to be used in the present invention has an average primary particle size of from about 1 nm to about 200 nm. In order to decrease the dust pollution during storage and transportation and when in use and to provide for easier handling, the powder may preferably be in the form of a granule. Such a granule may be formed utilizing the physicochemical or electric force of the surface of the powder. However, in the case where such a granule of powder is used, in order to facilitate the so-called slurry handling of the suspension, it is necessary to sufficiently pulverize the granule in a hydrocarbon oil in order to suspend it in the oil. To this end, it is preferred that a suspending operation be carried out by applying a shearing force at a shear rate as high as about $1\times10^4 sec^{-1}$ or more, preferably about $2\times10^4 sec^{-1}$ using a wet-type pulverizer capable of generating high shearing force. The upper limit of the shear rate is not critical. Generally, from the practical standpoint, the upper limit of the shear rate may be about $2\times10^5 sec^{-1}$. The granule may be pulverized to form a powder having a particle size of about 200 mesh (Tyler) (about 74 μm or less), preferably 325 mesh (Tyler) (about 43 μm or less).

The ratio of the powder of a carbonaceous substance to the molybdenum compound to be suspended in a hydrocarbon oil may be varied according to the type of the carbonaceous substance and the molybdenum compound used. Generally, it is preferred that the weight amount of a molybdenum compound, calculated as a weight of molybdenum, be smaller than the weight amount of the powder of the carbonaceous substance. Further, it is preferred that the ratio of the powder to the molybdenum compound be determined based on the total surface area of the powder of a carbonaceous substance to be used. For example, a molybdenum compound may generally be used in an amount of from 0.05 to 10 parts by weight, preferably 0.05 to 2 parts by weight calculated as a weight of molybdenum relative to 100 parts by weight of the powder of a carbonaceous substance having a surface area of 100 $m^2/g$ in terms of a value as measured by a BET method. Further, in the case where the powder of a carbonaceous substance has a surface area of 1000 $m^2/g$ in terms of a value as measured by BET method, the molybdenum compound may generally be used in an concentration of 0.05 to 100 parts by weight, preferably 0.05 to 20 parts by weight calculated as a weight of molybdenum relative to 100 parts by weight of the powder.

In the present invention, a total concentration of the powder of a carbonaceous substance and the molybdenum compound suspended in a hydrocarbon oil may be varied according to the types of the carbonaceous substance powder, the molybdenum compound, the solvent for the molybdenum compound and the hydrocarbon oil used, and the ratios thereof. When it is intended to decrease the amount of the hydrocarbon oil so that the scale of the additive preparation is reduced,, it is preferred that the total concentration of the powder and molybdenum compound in the hydrocarbon oil be increased. On the other hand, when it is intended to increase the fluidity of the resulting slurry and facilitate the slurry-handling thereof, it is preferred that the total concentration of the powder and molybdenum compound be decreased. Therefore, the total concentration of the powder and molybdenum compound in the hydrocarbon oil must be determined in view of the balance between the scale of the additive preparation and the facility of slurry-handling. Generally, the total concentration of the powder of a carbonaceous compound and the solution of a molybdenum compound in a hydrocarbon oil may be from about 2 to about 20% by weight in terms of a value as calculated by the formula:

$$\frac{A}{A+B}\times 100$$

wherein A is a total weight amount of the powder of a carbonaceous substance and the molybdenum compound, and B is a weight amount of the hydrocarbon oil.

The suspending operation of the powder of a carbonaceous substance and the solution of a molybdenum compound may be carried out at a temperature, which is higher than the pour point of a hdyrocarbon oil to be used and at which the fluidity of a mixture can be maintained during the suspending operation. However, it is necessary that the temperature, during the suspending of the solution of a molybdenum compound in a hydrocarbon oil, do not exceed the boiling point of a solvent of the molybdenum compound solution. For example, in the case where the solvent is water, the temperature during the suspending operation must not exceed 100° C. at atmospheric pressure .

The solvent of the molybdenum compound solution may be substantially removed by evaporation during the whole operation for the preparation of the additive. Especially in the case where the powder of a carbonaceous substance used is in the form of a granule, the granule must be pulverized after being suspended in the hydrocarbon oil, which causes the temperature of the slurry to be increased by the heat generated during the pulverizing operation. In such a case, the solvent of the molybdenum compound solution may automatically be distilled off by the heat generated by the pulverizing operation. Alternatively, the solvent may be distilled off by directly heating the slurry. According to the present invention, it is not critical whether or not the solvent of the molybdenum compound solution is completely removed.

The thus obtained additive may be used as such for the hydroconversion of a heavy hydrocarbon oil. The substance suspended in the obtained additive is not a catalyst but a catalyst precursor. However, when the additive containing the catalyst precursor is used for hydroconversion, the molybdenum compound in the catalyst precursor reacts with the sulfur or the sulfur compound contained in the hydrocarbon oil used for suspending the powder and molybdenum compound and/or the heavy hydrocarbon oil to be used as a feedstock for the hydroconversion. Alternatively, the precursor reacts with the hydrogen sulfide gas produced by the hydroconversion of the heavy hydrocarbon oil during the pre-heating of a mixture of a heavy hydrocarbon oil and additive and/or during the hydroconversion reaction, thereby to form molybdenum sulfide. The thus obtained suspended substance containing the molybdenum sulfide acts as a catalyst for the hydroconversion of a heavy hydrocarbon oil.

In order to ensure the formation of molybdenum sulfide from the molybdenum compound, sulfur or a sulfur compound may be added to a slurry obtained by suspending the powder of a carbonaceous substance and the solution of a molybdenum compound in a hydrocarbon oil. Examples of sulfur compounds include thiophenol, methylthiophene, diethylthiophene, thionaphthene, disphenylene sulfide, diethyl sulfide and the like. Of the sulfur and sulfur compounds, the most preferred is sulfur. It is sufficient that the sulfur or sulfur compound is added in an amount of 2 gram atoms or more of sulfur per gram atom of molybdenum. The upper limit of the amount of sulfur or sulfur compound is not critical. Generally, the upper limit may be about 4 gram atoms of sulfur per gram atom of molybdenum so that part or total amount of the sulfur or sulfur compound introduced is reacted with the molybdenum compound at the time of the hydroconversion of a heavy hydrocarbon oil. However, in the case where a molybdenum compound contains other transition metals than molybdenum, the amount of the sulfur or sulfur compound to be added may be increased taking into consideration the formation of sulfides of other transition metals than molybdenum. In the case of the sulfur, the form of the sulfur to be added is not critical. However, from the standpoint of dispersibility or solubility in a hydrocarbon oil, it is preferred that the sulfur may be in the form of powder having a particle size of, for example, 100 mesh (Tyler) (147 nm or less).

Incidentally, it should be noted that a chelating sulfur compound such as a tetraalkylthiuram disulfide and a dialkyldithiocarbonate must not be used as the sulfur compound because such a chelating sulfur compound reacts with the molybdenum compound to form an undesirable coordination compound and complex in which a heteropolymolybdic anion structure no longer exists, thus leading to a decrease in catalytic activity.

Further, the additive of the present invention which contains the catalyst precursor may be heated in an atmosphere containing no oxygen, preferably in an atmosphere of hydrogen gas so that the molybdenum compound in the catalyst precursor reacts with a sulfur or sulfur compound present in a hydrocarbon oil to form an amorphous molybdenum sulfide. The temperature of the heat treatment of the additive is not critical. Generally, the temperature may be about 350° C. to 500° C. The thus formed amorphous molybdenum sulfide has an excellent catalytic activity for the hydroconversion. The term "amorphous" used herein means that no crystals are detected according to an X-ray diffractometry. In this connection, it should be noted that if the molybdenum compound is not uniformly dispersed in the additive slurry, a crystalline molybdenum sulfide is formed by the heat treatment of the additive. The formation of such a crystalline molybdenum sulfide is not desirable because the catalytic activity decreases.

The mechanism that the additive of the present invention has an excellent catalytic activity for the hydroconversion of a heavy hydrocarbon oil has not yet been elucidated. However, it seems that the powder of the carbonaceous substance, the solution of the molybdenum compound and the hydrocarbon oil which are to be used in the present invention are interacted with one another to synergistically increase the dispersibility of the catalyst precursor or catalyst including a metal species having hydrogenation activity in a heavy hydrocarbon oil as a feedstock and, consequently, a high catalytic effect is brought about. Further, it appears that the high dispersibility of the catalyst precursor or catalyst, is ascribed to the specific structure of a heteropolymolybdic anion of the molybdenum compound. That is, the heteropolymolybdic acid has a distinctly unique single anion structure. For example, in the case where the molybdenum compound comprises $[PMo_{12}O_{40}]^{-3}$ anion, the anion has a structure that 12 octahedrons of $MoO_6$ (Mo atom is a central atom) and one tetrahedron of $PO_4$ (P atom is a central atom) are regularly condensed so that the tetrahedron is surrounded by the 12 octahedrons. In appearance, the anion is substantially spherical in shape and has a diameter of about 1 nm, and the surface of the anion is filled with 36 oxygen ions. Such a structure of the heteropolymolybdic anion is specific and completely different from the structures of the metal oxide ions of isopoly-acids and other mixed metal oxides and the metal ions of inorganic metal salts and organic metal salts, which are crystalline structures of boundless length. Furthermore, it is one of the advantageous characteristics of the present additive that a molybdenum compound to be used in the present invention can easily be reduced to form an amorphous molybdenum sulfide which is a metal species having a hydrogenating activity. Furthermore, it is another characteristic that the high dispersibility of a metal species having hydrogenating activity in a hydrocarbon oil can be attained owing to the fineness of average primary particle size of the powder of a carbonaceous substance and the affinity of this powder to a molybdenum compound and, in addition, probably owing to the ionic reaction and any other interactions between the molybdenum compound to be used in the present invention and nitrogen compounds contained in a hydrocarbon oil. The above-mentioned easiness in the formation of a metal species having hydrogenating activity and high dispersibility of such a metal species seem to bring about excellent catalytic activity for the hydroconversion of a heavy hydrocarbon oil.

Using the above-mentioned additive of the present invention, the hydroconversion of a heavy hydrocarbon oil can be effectively conducted. The type of heavy hydrocarbon oil which may be used as a feedstock for the hydroconversion is not critical. Examples of heavy hydrocarbon oils include paraffin base crude oils, naphthene base crude oils, aroma base crude oils, tar oils, shale oils, tar sand extract oils and the like. Further, an atmospheric or vacuum residual oils obtained by the distillation of the above-mentioned crude oils may also be employed as a feedstock to be hydroconverted.

The amount of the additive of the present invention to be added to a heavy hydrocarbon oil may be varied according to the types of a molybdenum compound, carbonaceous substance and raw heavy hydrocarbon oil, the type of an intended hydroconversion (that is, the type of lighter oils intended to produce, the types of improved properties of the hydroconversion products, etc.), and the type of hydroconversion reaction apparatus. In order to suppress the formation of by-product polycondensation substances such as cokes and asphaltenes and to prevent coking in a reaction apparatus, the additive of the present invention may generally be added to a raw heavy hydrocarbon oil in an amount such that the molybdenum concentration of the resulting mixture becomes about 5 to about 300 ppmw (part per million by weight), preferably about 10 to about 180 ppmw and the carbonaceous substance concentration becomes about 0.02 to about 1.5% by weight, preferably about 0.05 to about 1% by weight. Where it is intended to promote the hydrogenation of the hydroconversion products and the removal of the heteroatoms in the hydroconversion products, the amount of the additive may be increased so that the molybdenum concentration and carbonaceous substance concentration (especially molybdenum concentration) increase to an extent higher than the above-mentioned range.

After the addition of the additive to a raw heavy hydrocarbon oil, the resulting mixture is heated in the presence of a hydrogen gas or hydrogen gas-containing gas to conduct a hydroconversion of the heavy hydrocarbon oil. For attaining a high throughput of hydroconversion using a compact apparatus, it is preferred that the hydroconversion be conducted at a high temperature for a shortened period of time. Generally, the hydroconversion may be conducted at about 450° C. to about 520° C., preferably about 470° C. to about 500° C. for about 5 minutes to about 2 hours, preferably about 10 minutes to about 1 hour. As mentioned above, the hydroconversion is conducted in the presence of a hydrogen gas or hydrogen gas-containing gas. In the case of the hydrogen gas-containing gas, examples of other components than hydrogen gas include hydrocarbons such as methane and ethane, hydrogen sulfide, and the like. The hydrogen gas or hydrogen gas-containing gas may be introduced into a mixture of the additive and the heavy hydrocarbon oil at a hydrogen partial pressure of about 100 to about 300 kg/cm$^2$, preferably about 100 to about 200 kg/cm$^2$. The amount of a hydrogen gas or hydrogen gas-containing gas to be introduced into the mixture of the additive and the heavy hydrocarbon oil may be varied according to the reaction conditions for the hydroconversion. Generally, the hydrogen gas or hydrogen gas-containing gas may be introduced into the mixture of the additive and the heavy hydrocarbon oil so that the amount of hydrogen becomes about 200 to about 2000 m$^3$ (N.T.P.) per kl of the mixture, preferably about 300 to about 1000 m$^3$ (N.T.P.) per kl of the mixture.

The hydroconversion may be conducted using any conventional reaction apparatus as long as the apparatus is suitable for conducting the slurry reaction. Examples of reaction apparatuses include reaction apparatuses comprising a tubular reactor, a tower reactor and a soaker reactor.

Although the hydroconversion may be conducted in a batchwise manner, the hydroconversion may generally be conducted in a continuous manner from the practical standpoint. That is, a heavy hydrocarbon oil, an additive and a hydrogen gas are continuously supplied to the reaction zone in a reaction apparatus to conduct a hydroconversion of the heavy hydrocarbon oil while continuously collecting the hydroconversion products. The continuous hydroconversion may be conducted under the same conditions as mentioned above. However, it is preferred to use a reaction apparatus comprising a tubular reactor, because the flow rate of the mixture of the heavy hydrocarbon oil, additive and hydrogen gas or hydrogen gas-containing gas can be increased and therefore, a liquid (heavy hydrocarbon oil), solid (carbonaceous substances and molybdenum compound) and gas (hydrogen gas or hydrogen gas-containing gas) can be sufficiently mixed in the reaction zone of the reaction apparatus.

Now, the method for the hydroconversion of the present invention in which the hydroconversion is conducted in a continuous manner will be explained in detail referring to the Figure.

The flow diagram shown in Figure is comprised mainly of mixing zone 3 in which the additive and heavy hydrocarbon oil are mixed, reaction zone 6 in which the hydroconversion is conducted, separating zone 8 in which a gas phase and liquid phase are separated from each other, and distillation zone 12 in which the liquid phase separated from the gas phase in separating zone 8 is separated into fractions of petroleum products by distillation.

First, an additive of the present invention and a feedstock heavy hydrocarbon oil are introduced into mixing zone 3 through lines 1 and 2 and mixed sufficiently with each other. The resulting mixture in reaction zone 3 is pressurized by means of a pump and mixed in line 4 with a hydrogen gas or hydrogen gas-containing gas introduced through line 5, which gas has been pressurized by means of a compressor. Then, the mixture is introduced into reaction zone 6. In reaction zone 6, the mixture is heated to allow the reaction to proceed. The reaction mixture is taken out of reaction zone 6 and introduced into separating zone 8 through line 7 and the mixture is separated into a gas phase and a liquid phase. The gas phase is taken out of separating zone 8 through line 9. If desired, from the thus taken out gas phase, a lighter oil and undesirable gas components are removed to obtain a hydrogen-containing gas, and the hydrogen-containing gas may be introduced into line 5 through line 10 and recycled. On the other hand, the liquid phase is taken out through line 11 and the pressure of the liquid phase is reduced to an atmospheric pressure, and then, the liquid phase is introduced into distillation zone 12. The distillation zone may generally be comprised of an atmospheric distillator and a vacuum distillator which are connected linearly. In distillation zone 12, the liquid phase is separated into fractions, for example, light distillates such as a naphtha and kerosene, middle distillates such as a gas oil and vacuum gas oil, and a residue containing heavy distillates and solids such as the catalyst and polycondasation by-products, utilizing the difference in boiling points between the fractions. The separated light distillates and middle distillates are taken out through lines 13 and 14, respectively. The thus taken out distillates as such may be used as intermediate products for petroleum products, or feedstocks for petroleum chemicals. If desired, the taken out distillates may be refined by a customary petroleum refining process before using as intermediates or feedstocks mentioned above. On the other hand, the residue is taken out through line 15. The thus taken out residue as such may be used as a fuel oil for a customary boiler. The method in which a whole amount of the residue is taken out of the reaction apparatus is so-called a one-through reaction system. The residue still has a catalytic activity for the hydroconversion. Therefore, at least part of the residue may be introduced into reaction zone 3 through line 16, thereby recycling the residue. Such a system is so-called a recycle reaction system. The recycle reaction system has advantages in that the amount of a fresh additive to be added to the reaction zone can be decreased and that heavy oils contained in the residue are repeatedly subjected to a hydroconversion reaction and therefore, the conversion of a heavy hydrocarbon oil can be increased.

The additive of the present invention can be prepared easily, and by the use of the additive of the present invention, when a vacuum residual oil, for example, having a boiling point of at least 538° C. is used as a feedstock, at least 80% by weight, preferably at least 85% by weight, more preferably at least 90% by weight, of the vacuum residual oil can be converted to lighter oils having a boiling point of less than 538° C. Therefore, petroleum resources can be effectively utilized by the use of the additive and the hydroconversion method of the present invention.

The present invention will now be described in more detail with reference to Examples and Comparative Examples, which should in no way be construed to be limiting the scope of the present invention.

The heteropoly-acids and the transition metal salts thereof used in the following Examples and Comparative Examples were synthesized and purified by a customarily known method and identified by the measurement of the amount of metals by emission spectroscopic analysis, the structure analysis by X-ray diffractometry or infrared spectrophotometry, the thermal analysis, the measurement of the amount of crystal water by thermal analysis, and the measurement of oxidation-reduction electric potential by polarography. As a powder of a carbonaceous substance, the ones used are those which are commercially available.

EXAMPLE 1

Preparation of an additive for the hydroconversion 400 g of a residual oil (total content of fractions having a boiling point of 520° C. or more: 94.0 wt%, S content: 0.20 wt%, N content: 0.31 wt%, pour point: 56° C., kinematic viscosity: 240 cst (80° C.)) was heated to and kept at 75° C. To this hydrocarbon oil was added 55 g of a powder of a carbon black (average primary particle diameter as measured by an electron microscope: 20 nm, specific surface area in terms of a value as measured by a BET method: 130 $m^2/g$), thereby to obtain a slurry. Separately, 4.4 g of $H_3[PMo_{12}O_{40}]\cdot 29H_2O$ was dissolved in 4 g of deionized water to thereby obtain a yellowish solution. 2.1 g of the thus obtained yellowish solution and 0.7 g of sulfur powder of 100 mesh (Tyler) (147 μm) were added to the above-obtained slurry and subjected to agitation by means of a high speed stirrer-type disperser comprising a turbine (diameter : 28 mm) as a stirring blade and a stator and being capable of giving high shearing force to a fluid when the fluid passes through a clearance (0.4 mm) between the turbine and the stator. The agitation was conducted for 1 hour under the conditions of a revolution rate of 10,000 rpm, a peripheral speed of 16 m/s, a turbine discharge rate of 33 l/min and a power consumption of 0.06 kW so that a shearing force was applied to the slurry at a shear rate of 40,000 $sec^{-1}$. During the agitation operation, vaporization of water due to the heat generated by agitation was observed, and when the agitation operation was completed, the slurry was at a temperature of 135° C. The thus obtained slurry was subjected to a measurement of a Mo concentration by X-ray fluorometry, and it was found that the Mo concentration was 1,170 ppmw. Further, the slurry was subjected to a measurement of water content by Karl-Fischer's method, and it was found that the water content was less than 0.1 wt%. The slurry contained a catalyst precursor and had a Mo concentration of 1,180 ppmw and a carbonaceous substance concentration of 12.0 wt%, each based on the total weight of all the materials used for preparing the slurry (excluding the water used for preparing the aqueous solution of the molybdenum compound).

Hydroconversion

The hydroconversion was conducted in a batch-wise manner using as a reaction vessel an electromagnetic stirrer-type autoclave made of 316 stainless steel, having a capacity of 1 l and equipped with an external coil heater. 240 g of the same residual oil as used above was charged into the above-mentioned autoclave, and 20 g of the above-prepared slurry was added thereto. The resultant mixture contained a catalyst precursor in an amount that the Mo concentration was 91 ppmw and the carbonaceous substance concentration was 0.92 wt%. The pressure inside the autoclave was elevated to 120 $kg/cm^2$ at room temperature by means of a hydrogen gas, and the autoclave was then closed. The temperature inside the autoclave was raised to 470° C. at a temperature elevation rate of about 6° C./min, and the reaction was allowed to proceed at 470° C. for 35 min. After completion of the reaction, the inside temperature of the autoclave was lowered at a cooling rate of 15° C./min. The gas and slurry which were obtained as the reaction products were separately recovered and subjected to analyses. That is, the gas was subjected to gas chromatography, whereas an aliquot of the slurry was subjected to distillation analysis in accordance with ASTM D-1160, and another aliquot of the slurry was subjected to solvent extraction analysis. The results are shown in Table 1.

The conversion of the heavy hydrocarbon oil is defined by the formula:

$$\left(1 - \frac{\text{proportion of fraction having b.p. 520° C. or higher in product}}{\text{proportion of fraction having b.p. 520° C. or higher in feedstock}}\right) \times 100.$$

Asphaltenes are defined as those polycondensation by-products which are insoluble in hexane and soluble in tetrahydrofuran. Cokes are defined as those polycondensation by-products which are insoluble in tetrahydrofuran, excluding the catalyst or catalyst precursor. Further, after recovering the products, the autoclave was visually examined to determine whether or not cokes strongly adhered (coking) on the inner wall of the autoclave, the stirrer, and the protective tube of the thermocouple.

TABLE 1

| Example No. | 1 | 2 | 3 | 4 | 5 | 6 | 7 | 8 | 9 | 10 | 11 |
|---|---|---|---|---|---|---|---|---|---|---|---|
| Feedstock | Vacuum residue of a Minus crude oil (b.p. 520° C. or more: 94.0 wt %) | | | | | | | | | | |
| Conditions for hydro-conversion | 470° C., 35 min, 120 Kg/cm$^2$ (initial hydrogen pressure at room temperature) | | | | | | | | | | |
| Concentration of catalyst precursor[1] | 91 ppmW in terms of Mo, 092 wt % in terms of carbonaceous substance | | | | | | | | | | |
| hydrogen consumption (wt %)[1] | 1.1 | 1.1 | 1.2 | 1.1 | 1.1 | 1.2 | 1.1 | 1.2 | 1.2 | 1.2 | 1.3 |
| Components of product (wt %)[1] | | | | | | | | | | | |
| Gas | 2.6 | 2.8 | 2.8 | 2.4 | 2.5 | 2.3 | 2.6 | 2.5 | 3.1 | 2.9 | 2.6 |
| fractions of from IBP[2] to 520° C. (exclusive) | 81.7 | 83.3 | 83.8 | 84.2 | 80.7 | 84.2 | 83.3 | 82.5 | 83.3 | 80.0 | 80.8 |
| fractions of 520° C. or more | 16.8 | 15.0 | 14.6 | 14.5 | 17.9 | 14.7 | 15.2 | 16.2 | 14.8 | 18.3 | 17.9 |
| Oil | 14.3 | 12.7 | 11.5 | 11.7 | 15.7 | 12.1 | 12.6 | 13.8 | 11.6 | 15.4 | 15.0 |
| Asphaltene | 1.9 | 1.7 | 2.2 | 2.1 | 1.7 | 1.8 | 2.0 | 1.7 | 2.4 | 2.2 | 2.2 |
| Coke | 0.6 | 0.6 | 0.9 | 0.7 | 0.5 | 0.8 | 0.6 | 0.7 | 0.8 | 0.7 | 0.7 |
| Conversion (wt %) | 82.1 | 84.0 | 84.5 | 84.6 | 81.0 | 84.4 | 83.8 | 82.8 | 84.3 | 80.5 | 81.0 |
| Coking on the inner surface of the autoclave | Not observed | | | | | | | | | | |

Note
[1]Based on the weight of a feedstock
[2]Initial Boiling Point

EXAMPLES 2 TO 11

An additive was prepared in substantially the same manner as in Example 1 except that use was made of each of the aqueous solutions indicated below as a molybdenum compound solution, thereby to obtain additives each containing a catalyst precursor at a Mo concentration of 1180 ppmw and at a carbonaceous substance concentration of 12.0 wt%.

A hydroconversion was conducted in the same manner as in Example 1. The results are shown in Table 1. The molybdenum compound solutions employed in Examples 2 to 11 were as follows.

Example 2: 70 wt% aqueous solution of $H_6[P_2Mo_{18}O_{62}]\cdot 28H_2O$

Example 3: 30 wt% solution of $H_4[GeMo12O_{40}]\cdot 20H_2O$ in propanol

Example 4: 50 wt% aqueous solution of $H_8[CeMo_{12}O_{42}]\cdot 18H_2O$

Example 5: 40 wt% aqueous solution of $Cu_3[PMo_{12}O_{40}]_2\cdot 29H_2O$

Example 6: 28 wt% aqueous solution of $Ni_3[PMo_{12}O_{40}]_2\cdot 31H_2O$

Example 7: 35 wt% aqueous solution of $Mn_2[SiMo_{12}O_{40}]\cdot 18H_2O$

Example 8: 70 wt% aqueous solution of $H_4[PMo_{11}VO_{40}]\cdot 26H_2O$

Example 9: 50 wt% aqueous solution of $H_3[PMo_{10}W_2O_{40}]\cdot 18H_2O$

Example 10: 40 wt% aqueous solution of $H_3[CoMo_6O_{24}H_6]\cdot 12H_2O$

Example 11: 30 wt% solution of $H_4[SiMo_{12}O_{40}]\cdot 30H_2O$ in ethanol

COMPARATIVE EXAMPLES 1 TO 10

Preparation of an additive for the hydroconversion

In Comparative Examples 1 and 2, additives were prepared in substantially the same manner as in Example 1,respectively except that an aqueous solution of $H_3[PMo_{12}O_{40}].29H_2O$ was not used in Comparative Example 1 and that carbon black powder was not used in Comparative Example 2.

In Comparative Example 3, calcine cokes micropulverized by a jet crusher was used in place of the carbon black powder. In Comparative Example 4, a powder obtained by crushing γ-alumina (having a specific surface area of 220 m$^2$/g in terms of a value as measured by BET method and a pore volume of 0.43 ml/g) by a ball mill was used and passing the crushed alumina through a sieve of 400 mesh (Tyler) (37 μm) in place of the carbon black powder. The particle size distribution of each of the abovementioned powders was measured by a centrifugal sedimentation method. The results are shown below.

| Powder used in Comparative Example 3 | Powder used in Comparative Example 4 |
|---|---|
| >20 μm:10% | 37–20 μm:30% |
| 20–10 μm:23% | 20–10 μm:38% |
| 10–5 μm:30% | 10–5 μm:26% |
| 5–2 μm:25% | 5 μm >:6% |
| 2 μm >:12% | |

In each of Comparative Examples 3 and 4, a residual oil obtained by vacuum distillation of a Minus crude oil and an aqueous $H_3[PMo_{12}O_{40}]\cdot 29H_2O$ solution and sulfur powder were mixed together in the same weight ratio as in Example 1 at 80° C. and subjected to agitation by the same disperser as used in Example 1 for 10 min, thereby to obtain an emulsion. 35 g of each of the respective powder obtained above was added to the emulsion separately, and the mixture was agitated for 1 hour at 1000 rpm by a propeller type stirrer while heating up to 120° C. Each of the thus obtained slurries of Comparative Examples 3 and 4 contained molybdenum and powder at concentrations of 1230 ppm and 8.0 wt%, respectively.

In Comparative Example 5 to 8, substantially the same procedures as in Example 1 were repeated except that the below-mentioned solutions were employed in place of the aqueous $H_3[PMo_{12}O_{40}]\cdot 29H_2O$ solution in such amounts that the concentrations of Mo became 1180 ppm. Comparative Example Nos. and the solutions employed therein are as follows.

Comparative Example 5 : 8 wt% aqueous solution of $(NH_4)_6Mo_7O_{24}\cdot 4H_2O$ Comparative Example 6 : 50 wt% aqueous solution of $H_3[PW_{12}O_{40}]\cdot 31H_2O$ Comparative Example 7 : 30 wt% aqueous solution of $Na_4[SiMo_{12}O_{40}]\cdot 9H_2O$ Comparative Example 8 : 2 wt% aqueous solution of $(NH_4)_2H_2[SiMo_{12}O_{40}]\cdot 15H_2O$ In Comparative Examples 9 and 10, the same procedure as in Example 1 was repeated except that, in Comparative Example 9, a solid crystal of $H_3[PMo_{12}O_{40}].29H_2O$ was employed in place of the aqueous $H_3[PMo_{12}O_{40}].29H_2O$ solution, and that, in Comparative Example 10, 1.0 g of tetramethylthiuram disulfide was employed in place of the sulfur powder.

Hydroconversion

Using each of the slurries obtained separately in the above-mentioned Comparative Examples, a hydroconversion was conducted in the same manner as in Example 1. The results are shown in Table 2 together with the Mo and carbonaceous substance concentrations of the employed additive. Changes in the temperature and pressure inside the reaction vessels were recorded on the charts of the measuring apparatus with respect to all the comparative Examples, and it was found that in all Comparative Examples the temperature and pressure had undergone undesirable variation during the hydroconversion reaction after attaining the predetermined reaction temperature, although the time between the beginning of the hydroconversion and the initiation of the variation differs between Comparative Examples. In all Comparative Examples, the autoclave was opened and the slurry was taken out, and the autoclave was visually examined. As a result, it was found that clearly there was coking formed on the inner wall of the autoclave, the stirrer and the protective tube of the thermocouple, although there were some differences in the coking degree between Comparative Examples. Such coking was not observed in any of Examples 1 to 10.

As apparent from the comparison between the results shown in Table 1 and Table 2, the additive of the present invention exhibited an excellent catalytic activity while suppressing the formation of polycondensation by-products (asphaltene and coke) and coking (scaling) even under severe reaction conditions such as to attain a conversion of the heavy hydrocarbon oil as high as 80 wt% or over. In Examples 1 to 11, the formation of polycondensation by-products could be suppressed to a low level such that the content of coke in the residue having boiling points 520° C. or higher which was separated from the desired hydroconversion products was as small as from about 3 to 7 wt% and, even if the amount of the asphaltene, which is partly solid and partly colloidally dispersible, is added to the amount of the coke, the resultant amount is as small as from about 12 to 22 wt%, so that the slurry handling of the residue can be performed with substantially no difficulties.

TABLE 2

| Comparative Example No. | 1 | 2 | 3 | 4 | 5 | 6 | 7 | 8 | 9 | 10 |
|---|---|---|---|---|---|---|---|---|---|---|
| Feedstock | Vacuum residue of a Minus crude oil (b.p. 520° C. or more: 94 wt %) | | | | | | | | | |
| Conditions for hydroconversion | 470° C., 35 min, 120 Kg/cm² (initial hydrogen pressure at room temperature) | | | | | | | | | |
| Concentration of catalyst[1] precursor | | | | | | | | | | |
| Mo (ppmW) | — | 136 | 140 | | 113 | | | 91 | | |
| Powder (wt %) | 1.4 | — | 0.92 | | 1.15 | | | 0.92 | | |
| Hydrogen consumption (wt %) | 0.8 | 1.3 | 1.3 | 1.3 | 1.3 | 1.0 | 1.3 | 1.5 | 1.3 | 1.3 |
| Gas (wt %) | 5.3 | 4.0 | 3.7 | 4.5 | 3.3 | 4.8 | 3.6 | 4.0 | 3.5 | 4.6 |
| Asphaltene (wt %) | 3.1 | 4.2 | 4.0 | 3.2 | 3.3 | 2.9 | 2.9 | 3.8 | 3.5 | 3.3 |
| Coke (wt %) | 7.5 | 1.7 | 1.6 | 2.6 | 2.2 | 5.0 | 1.7 | 2.2 | 2.5 | 2.5 |
| Coking on the inner wall of the autoclave | Observed | | | | | | | | | |

Note
[1]same as in Table 1

EXAMPLE 12

Preparation of an additive for the hydroconversion 500 g of a vacuum gas oil fraction having the properties indicated in Table 3 was heated to 60° C., and added thereto were 20 g of granules of a porous carbonaceous substance (average primary particle diameter as measured by an electron microscope : 30 nm, specific surface area in terms of a value as measured by a BET method : 950 m²/g, pore volume : 1.15 ml/g, granule size distribution: $d_{10}$ 1.65 mm, $d_{50}$ 1.19 mm, $d_{90}$ 0.40 mm)

and 3.7 g of sulfur powder to thereby obtain a slurry. Separately, 7.6 g of $H_3[PMo_{12}O_{40}]\cdot 29H_2O$ was dissolved in 5 g of deionized water to obtain an aqueous solution and the thus obtained aqueous solution was added to the above-obtained slurry. The thus obtained mixture was agitated by means of the same disperser and in the same manner as in Example 1, thereby to obtain a hydrocarbon oil slurry in which the suspended materials were highly dispersed. Then, the hydrocarbon oil slurry was heated at 400° C. for 1 hour under a partial hydrogen pressure of 50 Kg/cm$^2$. The resultant slurry had a molybdenum concentration of 7010 ppmw and a carbonaceous substance concentration of 3.76 wt%, each based on the total weight of all the materials (excluding the water used for preparing the aqueous solution of the molybdenum compound).

An aliquot of the thus prepared catalyst containing slurry was subjected to filtration at 60° C. using a sieve of 325 mesh (43 μm) while flowing tetrahydrofuran therethrough. A solid substance was trapped by the sieve in a trace amount. On the other hand, another aliquot of the catalyst-containing slurry was subjected to filtration to collect a solid substance, and the solid substance was watered with and subjected to an extraction with hexane, and dried. The dried substance was subjected to a measurement by X-ray diffractometry using an X-ray diffractometer model Geigerflex RAD (manufactured and sold by Rigaku Electric Industries Co., Ltd., Japan) (Voltage and current : 40 kV 30 mA, Filter : Ni, Slit width : 0.05 mm (emission) and 0.15 mm (reception), Step : 0.01°, Preset time: 0.4 sec, Recorder: angle zoom of 0.2 mm/step). As a result, there was observed a very broad hollow between about 10° to 20° (2θ) without a distinct peak of molybdenum disulfide at 14.4° (2θ). This indicates that the thus formed molybdenum disulfide was amorphous.

Hydroconversion 242 g of a residual oil obtained by vacuum distillation of a Shengli crude oil (total content of fractions having a boiling point of 520° C. or more: 100 wt%, S content: 1.26 wt%, N content: 0.82 wt%) as a feedstock heavy hydrocarbon oil, and 8 g of the above-obtained slurry as an additive were charged in an autoclave having a capacity of 1 l. The mixture of the residual oil and the additive had a molybdenum concentration of 224 ppmw and a carbonaceous substance concentration of 1200 ppmw. Then, a hydrogen gas was charged in the autoclave at room temperature so that the hydrogen gas pressure inside the autoclave became 120 Kg/cm$^2$ and the hydroconversion was conducted batchwise at 470° C. for 25 min, thereby to obtain reaction products. The reaction products were analyzed in the same manner as in Example 1. The results are shown in Table 4.

EXAMPLE 13

Preparation of an additive for the hydroconversion and hydroconversion 500 g of the same residual oil as used in Example 12 as a feedstock heavy hydrocarbon oil was heated up to and kept at 80° C., and added thereto were the same granules of a porous carbonaceous substance, the same aqueous $H_3[PMo_{12}O_{40}]\cdot 29H_2O$ solution, and the same sulfur powder as used in Example 12 in amounts of 6 g, 8.4 g and 2.5 g, respectively, in the same manner as in Example 1 to prepare an additive for the hydroconversion.

250 g of the thus obtained slurry was charged in an autoclave of a capacity of 1 l and a hydrogen gas was charged in the autoclave to a pressure 140 Kg/cm$^2$ (at room temperature). The hydroconversion was conducted at 470° C. for 25 min. In this case, the mixture before being subjected to a hydroconversion had a Mo concentration of 0.49 wt% and a carbonaceous substance concentration of 1.17 wt%. The results are shown in Table 4.

The results shown in Table 4 indicate that the additive of the present invention is effective in the hydroconversion of a naphthene base heavy oil even under severe conditions such as to attain a conversion of the heavy hydrocarbon oil as high as 80 wt%, as in the hydroconversion of a paraffin base heavy oil in Examples 1 to 11.

The results of Examples 12 and 13 show that since the primary particles of the carbonaceous powder employed in Example 12 and 13 were not only ultrafine but also porous, the carbonaceous powder exhibited an excellent effect in preventing coking. In Example 12, the amount of the carbonaceous powder was small as compared with those of the carbonaceous powder used in Examples 1 to 11, but the coking was well prevented. In Example 12, the desulfurization and denitrogenation of the product oils were effectively performed so that 80 wt% of sulfur and 26 wt% of nitrogen were removed. In Example 13, the desulfurization and denitrogenation were more effectively performed so that 97 wt% of sulfur and 69 wt% of nitrogen were removed. This excellent effect in Example 13 was mainly due to the increase in the amount of a molybdenum compound.

TABLE 3

| Hydrocarbon oil (vacuum gas oil) employed for preparing the additive in Example 12 | | |
|---|---|---|
| IBP[2] | | 297° C. |
| Distillation ratio at respective temperature | 10 (Volume %) | 343 (°C.) |
| | 20 | 368 |
| | 30 | 388 |
| | 40 | 408 |
| | 50 | 427 |
| | 60 | 445 |
| | 70 | 463 |
| | 80 | 484 |
| | 90 | 506 |
| End point | | 547 |
| S content | | 0.05 wt % |
| N content | | 0.03 |
| pour point | | 43° C. |
| Kinematic viscosity (100° C.) | | 5 cst |

Note
[2]same as in Table 1

TABLE 4

| Example No. | 12 | 13 |
|---|---|---|
| Feedstock | Vacuum residu of a Shengli crude oil (b.p. 520° C. or more: 90.2 wt %) | |
| Conditions for hydroconversion | 470° C., 25 min, 120 kg/cm$^2$ (initial hydrogen pressure at room temperature) | 470° C., 25 min, 140 kg/cm$^2$ (initial hydrogen pressure at room temperature) |
| Mo concentration[1] | 224 ppmw | 0.49 wt % |
| Carbonaceous substance concentration[1] | 1200 ppmw | 1.17 wt % |
| Hydrogen consumption (wt %) | 1.6 | 2.3 |
| Components of | | |

TABLE 4-continued

| Example No. | 12 | 13 |
|---|---|---|
| product (wt %) | | |
| Gas | 3.7 | 3.3 |
| fractions of from IBP[2] to 343° C. (exclusive) | 50.0 | 53.5 |
| fractions of from 343 to 520° C. (exclusive) | 33.4 | 35.7 |
| fractions of from 520° C. or more | 14.5 | 9.8 |
| oil | 11.7 | 8.2 |
| Asphaltene | 1.8 | 0.6 |
| Coke | 1.0 | 1.0 |
| Conversion (%) | 83.4 | 89.1 |
| Coking on the inner surface of the autoclave | Not observed | Not observed |
| S content of product (wt %) | | |
| fractions of from IBP to 343° C. (exclusive) | 0.12 | 0.03 |
| fractions of 343 to 520° C. (exclusive) | 0.28 | 0.05 |
| fractions of 520° C. or more | 0.60 | 0.07 |
| N content of product (wt %) | | |
| fractions of from IBP to 343° C. (exclusive) | 0.24 | 0.12 |
| fractions of from 343 to 520° C. (exclusive) | 0.73 | 0.34 |
| fractions of 520° C. or more | 1.53 | 0.69 |

Note
[1, 2]same as in Table 1

COMPARATIVE EXAMPLE 11

Preparation of an additive for the hydroconversion

An additive was prepared in substantially the same manner as in Example 12 except that an aqueous solution obtained by dissolving 6.8 g of $(NH_4)_6Mo_7O_{24}\cdot 4H_2O$ in 80 g of deionized water was used instead of the aqueous solution of $H_3[PMo_{12}O_{40}]\cdot 29H_2O$. An aliquot of the additive was filtered using a sieve of 325 mesh (Tyler)(43 μm) while washing the sieve with tetrahydrofuran. As a result, 21% by weight of a solid was filtered off. The thus filtered off solid was subjected to X-ray diffractometry in substantially the same manner as in Example 12. As a result, a peak having a half width of about 2° (2θ) was observed at 14.4° (2θ) on the same scale as in the case of Example 12. This peak is sharp as compared with the broad peak observed in Example 12. This indicates that the solid formed in this Comparative Example had crystallinity.

Hydroconversion

The hydroconversion was effected in substantially the same manner as in Example 12 except that 8 g of the above-obtained additive was used. After the hydroconversion reaction, it was found that coking apparently occurred on the inner wall surface and protective tube of a thermocouple of the autoclave. The amounts of coke and asphaltene formed in the autoclave were 2.1% by weight and 4.2% by weight, respectively. The S content and N content of the product oil were 0.73% by weight and 0.72% by weight, respectively, and the desulfurization degree and denitrogenation degree were 42% by weight and 12% by weight, respectively.

EXAMPLE 14

Preparation of an additive for the hydroconversion

The preparation of an additive was conducted using a 200 l-capacity vessel which is provided with a conduit extending from the bottom of the vessel to the upper portion thereof and which conduit has a gear pump and a high speed rotary line mill positioned in the conduit. The line mill has 2 turbines, i.e. an inlet-side turbine and an outlet-side turbine each having a diameter of 90 mm, which are arranged on the same axis and the outlet side turbine has an attrition mill structure. The clearance between each of the outlet-side and inlet-side side turbines and a stator of the line mill is 0.8 mm.

125 Kg of a heavy oil having the properties shown in Table 5 was charged in the above-mentioned vessel and heated to and kept at 80° C., and to the heavy oil was added 22 kg of granules of a carbon black (average primary particle size: 22 nm, specific surface area in terms of a value as measured by a BET method: 120 $m^2/g$, granule size distribution: $d_{10}$ 1.60 mm, $d_{50}$ 0.92 mm, $d_{90}$ 0.25 mm), while stirring . Then, the gear pump and line mill were operated for 2 hours at a flow rate of 2 $m^3/h$ at a line mill revolution rate of 3600 rpm and at a line mill power consumption of 3.3 kW, thereby applying a shearing force to the mixture at a shear rate of about 40,000 $sec^{-1}$. 20 min after the start of the operation, an aqueous solution obtained by dissolving 550 g of $H_4[SiMo_{12}O_{40}]\cdot 30H_2O$ in 350 g of deionized water was added to the mixture. When the operation was finished, the temperature of the resultant highly dispersed slurry was 105° C. The thus obtained slurry had a molybdenum concentration of 1810 ppmw and a carbonaceous substance concentration of 14.9 wt%.

An aliquot of the above-obtained slurry was subjected to filtration at 60° C. using a sieve of 25 mesh (43 μm) while flowing tetrahydrofuran therethrough. A solid substance was trapped by the sieve in a trace amount. Further, another aliquot of the slurry was subjected to X-ray fluorescence analysis and water content analysis by Karl-Fischer's method. As a result, the Mo content and water content of the slurry were found to be 1800 ppmw and 0.2 wt%, respectively.

Hydroconversion

The above-prepared slurry was added as an additive to a residual oil obtained by vacuum distillation of a Khafji crude oil (total content of fractions having a b.p. of 520° C. or more: 96.6 wt%, S content: 4.13 wt%, N content: 0.25 wt%) in such an amount ratio that the molybdenum concentration and carbon black concentration in the mixture of the residual oil and the additive became 146 ppmw and 1.20 wt%, respectively, and the mixture was thoroughly stirred by means of a stirrer having a three-blade propeller as a stirring blade, at 500 rpm.

The hydroconversion was conducted in a continuous manner, using a 316 stainless steel-made flow reaction apparatus comprised mainly of a preheater having the shape of a spiral pipe of a size of ¼ inch × 5 m, a gas-liquid tower type reactor of 21 mm in inner diameter and 2.5 m in height, and a flusher of 36 mm in inner diameter and 3 m in height which is capable of separating a hydroconversion oil product into two fractions having boiling points respectively of less than 520° C. and of 520° C. or higher under atmospheric pressure. The hydroconversion were conducted at 480° C. at a retention time of 34 min under a reaction pressure of 200 Kg/cm$^2$ in a hydrogen/oil volume ratio of 1200 l(N.T.P.) per liter for 250 hours in a one-through reaction manner. The retention time (t) is defined by the equation $$t = \frac{V_0}{V_1} \times 60$$

wherein $V_0$ is a capacity of the reaction vessel (l) and $V_1$ is a feed rate (l/hr) of the mixture of the feedstock and the additive. The hydroconversion was stably performed throughout the operation period without causing any plugging to occur anywhere within the reactor and conduit. Reaction products were subjected to analyses and the results are shown in Table 6.

In Example 14, an aroma base heavy oil was employed as a feedstock heavy hydrocarbon oil as is different from Examples 1 to 13 in which a paraffin or naphthene base heavy oil was employed. The results of Example 14 shows that even in a continuous method using a flow reaction apparatus, the hydroconversion was stably performed with a conversion as high as 85 wt% or higher.

COMPARATIVE EXAMPLE 12

The preparation of an additive for the hydroconversion was conducted in substantially the same manner as in Example 14 except that an aqueous $(NH_4)_6Mo_7O_{24}$ solution which was used in Comparative Example 5, was employed in place of the aqueous $H_4[SiMo_{12}O_{40}]\cdot 30H_2O$ solution. The hydroconversion was conducted using the thus prepared additive. During the hydroconversion, a significant pressure drop was caused at the reactor inlet and outlet. Further, difficulties were encountered in taking out the product oil from the flusher after 20 hours from the commencement of the hydroconversion so that the continuation of the hydroconversion became difficult and, therefore, the operation had to be stopped. The inside of the reaction apparatus was visually examined, and it was found that significant amounts of solid substances were accumulated in the reactor and in the conduit between the reactor and the flusher. The total amount of the solid substances accumulated was 530 g.

TABLE 5

Hydrocarbon oil (fuel oil) as employed in the preparation of an additive in Examples 13 and 14

| | | |
|---|---|---|
| IBP[2] | | 294° C. |
| Distillation ratio at respective temperature | 10 (volume %) | 370 (°C.) |
| | 20 | 408 |
| | 30 | 436 |
| | 40 | 478 |
| | 50 | 541 |
| fractions of from IBP to 343° C. (exclusive) | | 5.7 wt % |
| fractions of from 343 to 520° C. (exclusive) | | 39.8 |
| fractions of 520° C. or more | | 54.5 |
| S content | | 0.13 wt % |
| N content | | 0.17 |
| Specific gravity (15/4° C.) | | 0.905 |
| Pour point | | 45° C. |
| Kinematic viscosity (100° C.) | | 21 cst |

Note
[2]same as in Table 1

TABLE 6

| Example No. | 14 |
|---|---|
| Feedstock | Vacuum residue of a Khafji crude oil (b.p. 520° C. or more: 96.6 wt %) |
| Conditions for hydroconversion | 480° C., 34 min 200 kg/cm$^2$ 1200 l (N.T.P.)/l ($H_2$/oil) |
| Concentration of catalyst precursor | Molybdenum concentration 146 ppmw Carbon black concentration 1.20 wt % |
| Hydrogen consumption | 2.1 wt % |
| Components of products (wt %) | |
| Gas | 11.9 |
| fractions of from IBP[2] to 343° C. (exclusive) | 48.6 |
| fractions of from 343 to 520° C. (exclusive) | 28.4 |
| fractions of 520° C. or more | 13.2 |
| Oil | 10.8 |
| Asphaltene | 1.7 |
| Coke | 0.8 |
| Conversion (wt %) | 85.8 |
| Amount of coking | 9 g |
| S contents of products[1] | |
| fractions of from IBP to 343° C. (exclusive) | 1.09 |
| fractions of from 343 to 520° C. (exclusive) | 2.64 |
| fractions of 520° C. or more | 4.22 |
| N contents of products[1] | |
| fractions of from IBP to 343° C. (exclusive) | 0.006 |
| fractions of from 343 to 520° C. (exclusive) | 0.20 |
| fractions of 520° C. or more | 0.80 |

Note
[1] *and* [2]same as in Table 1
[3]Amount of solid substance adhering on the inner wall of the reactor after completion of the operation

EXAMPLE 15

Preparation of an additive for the hydroconversion

An additive for the hydroconversion was prepared in substantially the same manner as in Example 14.

Hydroconversion

As a feedstock heavy hydrocarbon oil, a residual oil (total content of fractions having a boiling point of 520° C. or higher: 94.0% by weight, S content: 0.20% by weight, N content: 0.31% by weight) obtained by vacuum distillation of a Minus crude oil was used. The additive obtained above was added to the residual oil in an amount so that the molybdenum concentration and carbonaceous substance concentration of the resulting mixture became 117 ppmw and 0.96% by weight, respectively. A hydrocarbon gas was added to the mixture of the heavy hydrocarbon oil and the additive in an amount of 1100 l(N.T.P.) per liter of the mixture. Using the same reaction apparatus as in Example 14, the hydroconversion was conducted in a continuous manner in a one-through reaction manner at 490° C. under a pressure of 200 kg/m$^2$ for 250 hours. In practicing the hydroconversion, the mixture was flowed through the reaction zone of the reaction apparatus at a retention time of 32 min.

During the hydroconversion operation, no plugging occurred anywhere in the reaction apparatus and, therefore, the hydroconversion could be stably performed. The results are shown in Table 7.

EXAMPLE 16

Preparation of an additive for the hydroconversion 55 g of $H_3[PMo_{12}O_{40}]\cdot 29H_2O$ was dissolved in 30 g of deionized water. To the resulting solution was added ascorbic acid to advance 4-electron reduction reaction. Thus, an aqueous solution assuming blue was obtained. On the other hand, 30 g of polybutenylsuccinic amide was added to 16 kg of the same residual oil as used as the feedstock heavy hydrocarbon oil in Example 15. The mixture was heated at 80° C., and to the heated mixture were added a whole amount of the above-obtained blue aqueous solution and 25 g of sulfur powder having a particle size of 100 mesh (Tyler) (147 μm or less). The resulting mixture was mixed sufficiently using a high speed stirrer-type disperser having a turbine of 50 mm in diameter as a stirring blade. The clearance between the turbine and a stator of the disperser was 0.5 mm and the turbine of the disperser was rotated at 8000 rpm at a peripheral velocity of 21 m/s, a turbine flow rate of 200 l/min and a power consumption of 1.0 kW so that a shearing force was applied to the mixture at a shear rate of 40,000 $sec^{-1}$. Thus, a water/oil emulsion was obtained. While stirring the mixture under the same revolution conditions as mentioned above, 2.8 kg of carbon black granules (average primary particle size as measured by an electron microscope: 50 nm, specific surface area in terms of a value as measured by a BET method: 58 $m^2/g$, size distribution of granules : $d_{10}$2.05 mm, $d_{50}$ 1.38 mm, $d_{90}$ 0.76 mm) was added to the above-obtained mixture, and pulverization of the carbon black granules in the mixture and mixing of the pulverized carbon black with the mixture were sufficiently performed for 2 hours to obtain an additive for the hydroconversion. The additive had a molybdenum concentration of 1430 ppmw and a carbon black concentration of 14.8% by weight.

Hydroconversion

As a feedstock heavy hydrocarbon oil, a residual oil as in Example 15 was used. The additive obtained above was added to the residual oil in an amount such that the molybdenum concentration and carbon black concentration of the resulting mixture became 33 ppmw and 0.34% by weight, respectively. A hydrogen gas was mixed with the mixture of the heavy hydrocarbon oil and the additive in an amount of 950 l(N.T.P.) per liter of the mixture. The hydroconversion was conducted in a continuous manner by the so-called recycle reaction system using substantially the same reaction apparatus as in Example 14 except that the reaction apparatus is additionally provided with a circulation line for introducing the bottom oil obtained in the distillation zone (flusher) of the reaction apparatus into the reaction zone (reactor), at 485° C. under a pressure of 180 $kg/cm^2$ for 300 hours while recycling the bottom oil in the flusher at a recycle ratio (a recycled bottom oil/feedstock heavy hydrocarbon oil weight ratio) of 0.34. In practicing the hydroconversion, the mixture was flowed through the reaction zone of the reaction equipment at a retention time of 22 min.

During the hydroconversion operation, no plugging occurred anyplace in the reaction apparatus and, therefore, the hydroconversion could be stably performed. The results are shown in Table 7.

As is apparent from the results shown Table 7, according to the present invention, a stable hydroconversion could be conducted in a continuous manner by either a one-through reaction system (Example 15) or a recycle reaction system (Example 16) even under severe hydroconversion conditions such as to attain about 90% by weight conversion of the heavy hydrocarbon oil.

Further, it was found that when the hydroconversion was effected by a recycle reaction system (Example 16), the amounts of the molybdenum compound and carbonaceous substance could be reduced without sacrificing the catalytic effect, as compared with the case where the hydroconversion was conducted by a one-through reaction system (Example 15).

Furthermore, it was found that by adopting the recycle reaction system, the hydroconversion could be performed under relatively mild conditions as compared with the case of the one-through reaction system (Example 15), so that the consumption of a hydrogen and the generation of gaseous by-products could be decreased.

TABLE 7

| Example No. | 15 | 16 |
|---|---|---|
| Feedstock | Vacuum residue of a Minus crude oil (b.p. 520° C. or more: 94.0 wt %) | |
| | one-through reaction system | Recycle reaction system |
| Conditions | 490° C., 32 min. 200 $kg/cm^2$ 1100 l (N.T.P.)/l ($H_2$/oil) | 485° C., 22 min 180 $kg/cm^2$ 950 l (N.T.P.)/l ($H_2$/oil), Recycle ratio: 0.34 |
| Molybdenum concentration[1] | 117 ppmw | 33 ppmw |
| Carbon black concentration[1] | 0.96 wt % | 0.34 wt % |
| Hydrogen consumption (wt %) | 1.5 | 1.25 |
| Components of product (wt %) | | |
| Gas | 7.1 | 0.3 |
| fraction of from IBP[2] to 343° C. (exclusive) | 54.3 | 47.1 |
| fractions of from 343 to 520° C. (exclusive) | 30.8 | 38.2 |
| fractions of from 520° C. or more | 9.3 | 9.2 |
| oil | 6.6 | 6.2 |
| Asphaltene | 1.7 | 2.2 |
| Coke | 1.0 | 0.8 |
| Conversion (wt %) | 89.8 | 90.2 |
| Amount of coking[3] | 25 g | 32 g |
| S conduct of product (wt %) | | |
| to 343° C. (exclusive) | 0.06 | 0.05 |
| fractions of from 343 to 520° C. (exclusive) | 0.11 | 0.09 |
| fractions of 520° C. or more | 0.23 | 0.28 |
| N content of product (wt %) | | |
| fractions of from IBP to 343° C. (exclusive) | 0.08 | 0.06 |
| fractions of from 343 to 520° C. (exclusive) | 0.33 | 0.30 |
| fractions of 520° C. or more | 1.00 | 0.96 |

Note
[1] *and* [2]same as in Table 1,
[3]same as in Table 6

What is claimed is:

1. An additive for the hydroconversion of a heavy hydrocarbon oil, which is obtained by a process comprising suspending in a hydrocarbon oil:

(i) a carbon black having an average particle size of from about 1 to 200 nm, and (ii) a solution comprising at least one molybdenum compound selected from the group consisting of a heteropolyacid containing a molybdenum atom as a polyatom and a transition metal salt thereof, dissolved in an oxygen-containing polar solvent, thereby obtaining a suspension, wherein the weight amount of said molybdenum compound calculated as weight of molybdenum if smaller than the weight amount of said carbon black.

2. The additive according to claim 1, wherein said process further comprises adding sulfur or a sulfur compound to said suspension in an amount of 2 gram atoms or more of sulfur per gram atom of molybdenum, and dispersing said sulfur or sulfur compound in said suspension.

3. The additive according to claim 1, wherein said process further comprises heating said suspension in the presence of sulfur.

4. The additive according to any of claims 1 to 3, wherein said carbon black has an average particle size of from about 1 to 50 nm.

5. The additive according to any of claims 1 to 3, wherein said carbon black has a surface area of from about 50 to 250 $m^2/g$ in terms of a value as measured by a BET method.

6. The additive according to any of claims 1 to 3, wherein said carbon black is porous and has a surface area of from about 200 to 1500 $m^2/g$ in terms of a value as measured by a BET method.

7. The additive according to any of claims 1 to 3, wherein said molybdenum compound is at least one member selected from the group consisting of heteropolymolybdic acids and mixed heteropoly-acids containing a molybdenum and a transition metal atom as polyatoms, wherein the ratio of the number of molybdenum atoms to the total number of polyatoms is at least 0.7.

8. The additive according to any of claims 1 to 3, wherein said molybdenum compound comprises an anion selected from the group consisting of $[X^{+n}Mo_{12}O_{40}]^{-(8-n)}$, $[X^{+n}Mo_{12}O_{42}]^{-(12-n)}$, $[X^{+5}{}_2Mo_{18}O_{62}]^{-6}$, $[X^{+4}Mo_9O_{32}]^{-6}$, $[X^{+n}Mo_6O_{24}]^{-(12-n)}$, $[X^{+n}Mo_6O_{24}H_6]^{-(6-n)}$, $[X^{+n}Mo_{12-m}W_mO_{40}]^{-(8-n)}$, and $[X^{+n}Mo_{12-m}V_mO_{40}]^{-(8-n+m)}$, wherein X stands for a heteroatom capable of forming a heteropoly anion, n is the valence of X, and m is an integer of from 1 to 3.

9. The additive according to any of claims 1 to 3, wherein said heteropoly-acid and said transition metal salt thereof are each 2-, 4- or 6-electron reduced species.

10. The additive according to any of claims 1 to 3, wherein said transition metal salt contain a cation selected from the group consisting of $Cu^{2+}$, $Mn^{2+}$, $Ni^{2+}$, $Co^{2+}$, $Fe^{3+}$, $Cr^{3+}$and $Zn^{2+}$.

11. The additive according to claim 8, wherein said molybdenum compound contains an anion selected from the group consisting of $[PMo_{12}O_{40}]^{-3}$, $[SiMo_{12}O_{40}]^{-4}$, $[GeMo_{12}O_{40}]^{-4}$, $[P_2Mo_{18}O_{62}]^{-6}$, $[CeMo_{12}O_{42}]^{-8}$, $[PMo_{11}VO_{40}]^{-4}$, $[SiMo_{11}VO_{40}]^{-5}$, $GeMo_{11}VO_{40}]^{-4}$, $[PMo_{11}WO_{40}]^{-3}$, $[SiMo_{11}VO_{40}]^{-4}$, $CoMo_6O_{24}H_6]^{-3}$, and reduced forms thereof.

12. The additive according to any of claims 1 to 3, wherein said oxygen-containing polar solvent is water.

13. The additive according to any of claims 1 to 3, wherein said hydrocarbon oil is an oil containing a nitrogen compound.

14. The additive according to any of claims 1 to 3, wherein said hydrocarbon oil is a fuel oil.

15. The additive according to any of claims 1 to 3, wherein said hydrocarbon oil is a heavy hydrocarbon oil selected from the group consisting of paraffin base crude oils, naphthene base crude oils, aroma base crude oils, tar oils, shale oils, tar sand extract oils and atmospheric or vacuum residual oils obtained from said oils.

16. The additive according to any of claims 1 to 3, wherein said suspending is carried out by applying a shearing force at a shear rate of at least $1\times10^4$ $sec^{-1}$.

17. The additive according to any of claims 1 to 3, wherein said suspending is carried out at a temperature not exceeding the boiling point of said oxygen-containing polar solvent.

18. The additive according to any of claims 1 to 3, wherein said oxygen-containing polar solvent is substantially removed by evaporation during said suspending.

19. The additive according to any of claims 1 to 3, wherein the total concentration of said carbon black and said molybdenum compound in said hydrocarbon oil is of from about 2 to 20% by weight in terms of a value as calculated by the formula:

$$\frac{A}{A+B}\times 100$$

wherein A is the total weight amount of said carbon black and said molybdenum compound, and B is a weight amount of said hydrocarbon oil.

* * * * *